US012281793B1

(12) United States Patent
Zhao et al.

(10) Patent No.: US 12,281,793 B1
(45) Date of Patent: Apr. 22, 2025

(54) FUEL INJECTION ASSEMBLY FOR A COMBUSTOR

(71) Applicant: GE Infrastructure Technology LLC, Greenville, SC (US)

(72) Inventors: Wei Zhao, Greer, SC (US); Wessam Sherif Estefanos, Simpsonville, SC (US); Thomas Edward Johnson, Greer, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/425,018

(22) Filed: Jan. 29, 2024

(51) Int. Cl.

| | |
|---|---|
| ***F23R 3/00*** | (2006.01) |
| ***F23D 14/64*** | (2006.01) |
| ***F23D 14/70*** | (2006.01) |
| ***F23R 3/28*** | (2006.01) |
| ***F23R 3/34*** | (2006.01) |

(52) U.S. Cl.
CPC ..... *F23R 3/002* (2013.01); *F23D 14/64* (2013.01); *F23D 14/70* (2013.01); *F23R 3/286* (2013.01); *F23R 3/346* (2013.01)

(58) Field of Classification Search
CPC ..... F23D 14/64; F23D 14/70; F23R 3/286; F23R 3/346
See application file for complete search history.

(56) References Cited

U.S. PATENT DOCUMENTS

| | | | |
|---|---|---|---|
| 4,903,480 | A | 2/1990 | Lee et al. |
| 5,220,787 | A | 6/1993 | Bulman |
| 5,640,851 | A | 6/1997 | Toon et al. |
| 6,868,676 | B1 | 3/2005 | Haynes |
| 6,915,636 | B2 | 7/2005 | Stuttaford et al. |
| 7,878,000 | B2 | 2/2011 | Mancini et al. |
| 8,113,001 | B2 | 2/2012 | Singh et al. |
| 8,171,735 | B2 | 5/2012 | Mancini et al. |
| 8,387,391 | B2 | 3/2013 | Patel et al. |
| 8,387,398 | B2 | 3/2013 | Martin et al. |
| 8,438,856 | B2 | 5/2013 | Chila et al. |
| 8,590,311 | B2 | 11/2013 | Parsania et al. |
| 8,745,987 | B2 | 6/2014 | Stoia et al. |
| 8,863,525 | B2 | 10/2014 | Toronto et al. |
| 8,943,831 | B2 | 2/2015 | Eroglu et al. |
| 9,267,436 | B2 | 2/2016 | Stoia et al. |

(Continued)

FOREIGN PATENT DOCUMENTS

| | | | |
|---|---|---|---|
| EP | 2208934 | A1 | 7/2010 |

*Primary Examiner* — Scott J Walthour
(74) *Attorney, Agent, or Firm* — Dority & Manning, P.A.

(57) ABSTRACT

A fuel injection assembly for a combustor of a gas turbine engine includes a body with a head section that defines an air intake chamber. A mixing chamber is disposed below the air intake chamber. A deflection member is disposed in the air intake chamber and includes an upper deflection surface and sides spaced apart from inner wall surfaces of the air intake chamber such that peripheral air passages are defined for air to pass from the air intake chamber into the mixing chamber. A plurality of radially extending and longitudinally spaced-apart ribs is disposed along longitudinal side walls of the mixing chamber. A fuel plenum is disposed along the longitudinal side walls of the mixing chamber, and a plurality of fuel injection holes is defined from the fuel plenum through the longitudinal side walls of the mixing chamber and at least some of the ribs.

20 Claims, 7 Drawing Sheets

(56) References Cited

U.S. PATENT DOCUMENTS

| | | | | |
|---|---|---|---|---|
| 9,291,250 | B2 | 3/2016 | Reiter et al. | |
| 9,291,350 | B2 | 3/2016 | Melton et al. | |
| 9,303,872 | B2 | 4/2016 | Hadley et al. | |
| 9,316,155 | B2 | 4/2016 | DiCintio et al. | |
| 9,316,396 | B2 | 4/2016 | DiCintio et al. | |
| 9,322,556 | B2 | 4/2016 | Melton et al. | |
| 9,360,217 | B2 | 6/2016 | DiCintio et al. | |
| 9,376,961 | B2 | 6/2016 | Stoia et al. | |
| 9,383,104 | B2 | 7/2016 | Melton et al. | |
| 9,400,114 | B2 | 7/2016 | Melton et al. | |
| 10,054,314 | B2 | 8/2018 | Kapilavai et al. | |
| 10,690,349 | B2 | 6/2020 | Natarajan et al. | |
| 10,718,523 | B2 | 7/2020 | Gubba et al. | |
| 10,851,999 | B2 | 12/2020 | Cai et al. | |
| 10,865,992 | B2 | 12/2020 | DiCintio et al. | |
| 2010/0236252 | A1* | 9/2010 | Huth | F23R 3/14 60/748 |
| 2012/0272659 | A1 | 11/2012 | Syed et al. | |
| 2013/0091846 | A1* | 4/2013 | Hadley | F23D 14/64 60/737 |
| 2013/0174558 | A1 | 7/2013 | Stryapunin | |
| 2014/0260280 | A1 | 9/2014 | Willis et al. | |
| 2014/0260318 | A1 | 9/2014 | Willis et al. | |
| 2014/0360193 | A1 | 12/2014 | Stoia et al. | |
| 2015/0285501 | A1 | 10/2015 | DiCintio et al. | |

* cited by examiner

FUEL INJECTION ASSEMBLY FOR A COMBUSTOR

FIELD

The present disclosure relates generally to fuel injectors for gas turbine combustors and, more particularly, to fuel injectors for use with an axial fuel staging (AFS) system associated with such combustors.

BACKGROUND

Turbomachines are utilized in a variety of industries and applications for energy transfer purposes. For example, a gas turbine engine is a turbomachine that generally includes a compressor section, a combustion section, a turbine section, and an exhaust section in serial flow order. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

In some combustors, the generation of combustion gases occurs at two, axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone. The cross-flow is generally transverse to the flow of combustion products from the primary combustion zone.

Traditional gas turbine engines include one or more combustors that burn a mixture of natural gas and air within the combustion chamber to generate the high pressure and temperature combustion gases. As a byproduct, oxides of nitrogen (NOx) and other pollutants are created and expelled by the exhaust section. Regulatory requirements for low emissions from gas turbines are continually growing more stringent, and environmental agencies throughout the world are now requiring even lower rates of emissions of NOx and other pollutants from both new and existing gas turbines.

Burning a mixture of natural gas and high amounts of hydrogen and/or burning pure hydrogen instead of natural gas within the combustor would significantly reduce or eliminate the emission of NOx and other pollutants. However, because hydrogen burning characteristics are different than those of natural gas, traditional combustion systems, including traditional AFS fuel injectors, are not capable of burning high levels of hydrogen and/or pure hydrogen without issue. For example, burning high levels of hydrogen and/or pure hydrogen within a traditional combustion system could promote flashback or flame holding conditions in which the combustion flame migrates towards the fuel being supplied by the injector, possibly causing severe damage to the injector in a relatively short amount of time.

As such, a fuel injection assembly capable of delivering alternative fuels (such as hydrogen) and air to a secondary combustion zone, without causing flame holding or flashback issues, is desired in the art.

BRIEF DESCRIPTION

Aspects and advantages of the fuel injection assemblies and combustors in accordance with the present disclosure will be set forth in part in the following description, or may be obvious from the description, or may be learned through practice of the technology.

In accordance with aspects of the present disclosure, an embodiment of a fuel injection assembly for a combustor of a gas turbine engine is provided that offers a solution to the issues discussed above. The fuel injection assembly includes a body having a head section defining an air intake chamber. A mixing chamber is disposed below the air intake chamber and includes transverse end walls and longitudinal side walls. A deflection member is disposed in the air intake chamber and includes an upper deflection surface and sides spaced apart from an inner wall of the air intake chamber such that peripheral air passages are defined between the deflection member and the inner wall of the air intake chamber for air to pass from the air intake chamber into the mixing chamber. A plurality of radially extending and longitudinally spaced-apart ribs is disposed along each of the longitudinal side walls of the mixing chamber. A fuel plenum is disposed along the longitudinal side walls of the mixing chamber. A first plurality of fuel injection holes defines passages from the fuel plenum, through the longitudinal side walls of the missing chamber, through the ribs, and into the mixing chamber. This unique configuration enhances turbulent mixing of the pressurized air/fuel mixture in the mixing chamber, thereby providing for a more efficient and complete ignition of the mixture at the secondary combustion zone and minimizing flashback and flame holding conditions.

In one embodiment, the air intake chamber includes transverse end walls and longitudinal side walls, the sides of the deflection member spaced from and parallel to the inner wall surfaces of the longitudinal side walls of the air intake chamber such that the peripheral air passages are defined as slots extending along each of the longitudinal side walls of the air intake chamber. In this embodiment, the deflection member may extend between and be mounted to the transverse end walls of the air intake chamber.

In an embodiment, the air intake chamber may have a cross-sectional area that is greater than a cross-sectional area of the mixing chamber, wherein a throat section is defined between the air intake chamber and the mixing chamber. The throat section may have a tapered cross-sectional profile from the air intake chamber to the mixing chamber.

In some embodiments, the air intake chamber may have a rectangular cross-sectional shape, and the mixing chamber may have a smaller rectangular cross-sectional shape.

In still a further embodiment, the fuel plenum may include an external fuel duct adjacent to an outer surface of each of the longitudinal side walls of the mixing chamber, wherein the first plurality of fuel injection holes is in fluid communication with the fuel duct and is defined through the longitudinal sidewalls of the mixing chamber. In this embodiment, the air intake chamber may include transverse end walls, longitudinal side walls, and a stepped ledge between the longitudinal side walls of the intake chamber and the mixing chamber, wherein the external fuel duct is disposed under the stepped ledge.

The deflection member may have various shapes. For example, in one embodiment, the deflection member may have a sloped or curved lower surface that extends from the sides of the deflection member into the throat section between the air intake chamber and the mixing chamber. Alternatively, the lower deflection surface of the deflection member may be flat.

Similarly, the upper deflection surface of the deflection member may be sloped or curved towards the sides of the deflection member in one embodiment or may be flat in another embodiment.

The ribs that extend radially within the mixing chamber to an outlet end of the mixing chamber may also be variously configured. In one embodiment, the ribs may be blade-shaped with a relatively straight edge that is parallel to a centerline axis of the mixing chamber. In an alternate embodiment, this edge may be scalloped, tapered, or otherwise profiled into a non-straight edge.

The fuel injection holes may be defined through a front face or apex of the ribs and/or through side walls of the ribs.

In still a further embodiment, the fuel injection assembly may include a second plurality of fuel injection holes defining a passage from the fuel plenum and through the ribs into the mixing chamber, wherein the second plurality of fuel injection holes are spaced vertically from the first plurality of fuel injection holes.

The present disclosure also encompasses an axial fuel staging (AFS) combustor for a gas turbine. The AFS combustor includes a head end and one or more fuel nozzles configured at the head end. A combustion liner extends downstream from the one or more fuel nozzles and defines a primary combustion zone at a forward end of the combustion liner and a secondary combustion zone at an aft end of the combustion liner. A fuel injection assembly is disposed through the liner at the secondary combustion zone downstream from the primary combustion zone. This fuel injection assembly is in accordance with any one or combination of the injection assemblies discussed above.

These and other features, aspects and advantages of the present fuel injection assemblies and combustors will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel injection assemblies and combustors, including the best mode of making and using the present systems and methods, directed to one of ordinary skill in the art, is set forth in the specification, which makes reference to the appended figures, in which.

DETAILED DESCRIPTION

Figure 1:
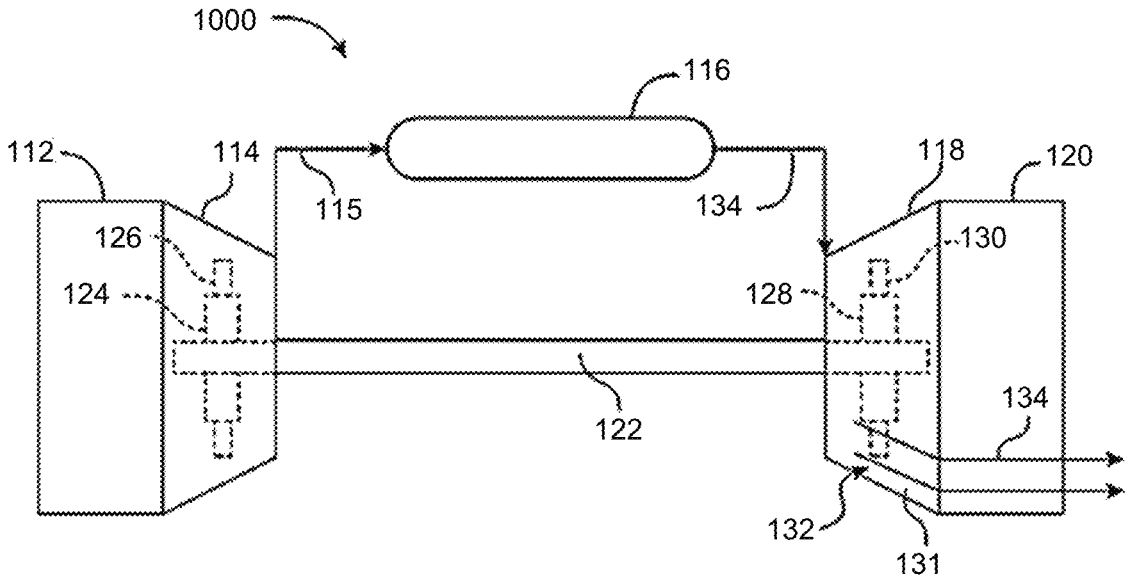
FIG. 1 is a schematic illustration of a turbomachine, in accordance with embodiments of the present disclosure.

Reference now will be made in detail to embodiments of the present fuel injection assemblies and combustors, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the subject technology. As used herein, the terms "first", "second", and "third" may be used interchangeably to distinguish one component from another and are not intended to signify location or importance of the individual components.

The term "fluid" may refer to a gas or a liquid. The term "fluid communication" means that a fluid is capable of flowing or being conveyed between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component. A first component that is radially inward of a second component (i.e., relative to an axial centerline of a combustor) may be referred to herein as "below" or "under," regardless of the installed position of the components on the combustor. Such components may also be referred to as being "spaced vertically" or "vertically spaced."

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values, and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled," "directly fixed," "directly attached to," and the like indicated that a first component is joined to a second component with no intervening structures. As used herein, the terms "comprises." "comprising." "includes," "including," "has," "having" or any other variations thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive selection and not to an exclusive selection. For example, a condition A or B is satisfied by any one of the following: A is true (or present) and B is false (or not present), and A is false (or not present) and B is true (or present).

Here and throughout the specification and claims, range limitations are identified and include all the sub-ranges contained therein unless context or language indicates otherwise. For example, all ranges disclosed herein are inclusive of the endpoints, and the endpoints are independently combinable with each other.

As used herein, the term "premix" may be used to describe a component, passage, or cavity upstream of a respective combustion zone within which mixing occurs. For example, "premix" may be used to describe a component, passage, or cavity in which two fluids (such as fuel and air) are mixed together prior to being ejected from such component, passage, or cavity (e.g., into a combustion zone).

Referring now to the drawings, FIG. 1 illustrates a schematic diagram of one embodiment of a turbomachine, which in the illustrated embodiment is a gas turbine engine 1000. Although an industrial or land-based gas turbine is shown and described herein, the present disclosure is not limited to an industrial or land-based gas turbine engine unless otherwise specified in the claims. For example, the technology as described herein may be used in any type of turbomachine including but not limited to a steam turbine, an aircraft gas turbine, or a marine gas turbine.

As shown, gas turbine engine 1000 generally includes in serial flow order: an inlet section 112, a compressor section 114 disposed downstream of the inlet section 112, a plurality of combustors (shown in FIG. 2) within a combustion section 116 disposed downstream of the compressor section 114, a turbine section 118 disposed downstream of the combustion section 116, and an exhaust section 120 disposed downstream of the turbine section 118. Additionally, the gas turbine engine 1000 may include one or more shafts 122 coupled between the compressor section 114 and the turbine section 118.

The compressor section 114 may generally include a plurality of rotor disks 124 (one of which is shown) and a plurality of rotor blades 126 extending radially outwardly from and connected to each rotor disk 124. Each rotor disk 124 in turn may be coupled to or form an upstream portion of the shaft 122 that extends through the compressor section 114. The compressor section 114 further includes a plurality of stationary vanes (not shown), which are arranged in stages with the rotor blades 126 and which direct the flow against the rotor blades 126.

The turbine section 118 may generally include a plurality of rotor disks 128 (one of which is shown) and a plurality of rotor blades 130 extending radially outwardly from and being interconnected to each rotor disk 128. Each rotor disk 128 in turn may be coupled to or form a downstream portion of the shaft 122 that extends through the turbine section 118. The turbine section 18 further includes an outer casing 131 that circumferentially surrounds the downstream portion of the shaft 122 and the rotor blades 130, thereby at least partially defining a hot gas path 132 through the turbine section 118. The turbine section 118 further includes a plurality of stationary vanes (not shown), which are arranged in stages with the rotor blades 130 and which direct the flow against the rotor blades 130.

During operation, a working fluid such as air flows through the inlet section 112 and into the compressor section 114 where the air is progressively compressed by multiple compressor stages of rotating blades and stationary vanes, thus providing pressurized air 115 to the combustors 10 (FIG. 2) of the combustion section 116. The pressurized air 115 is mixed with fuel and burned within each combustor 10 to produce combustion gases 134. The combustion gases 134 flow through the hot gas path 132 from the combustion section 116 into the turbine section 118, in which the combustion gases 134 expand and energy (kinetic and/or thermal) is transferred from the combustion gases 134 to the rotor blades 130, causing the shaft 122 to rotate. The mechanical rotational energy may then be used to power the compressor section 114 and/or to generate electricity. The combustion gases 134 exiting the turbine section 18 may then be exhausted from the gas turbine engine 1000 via the exhaust section 120.

Figure 2:
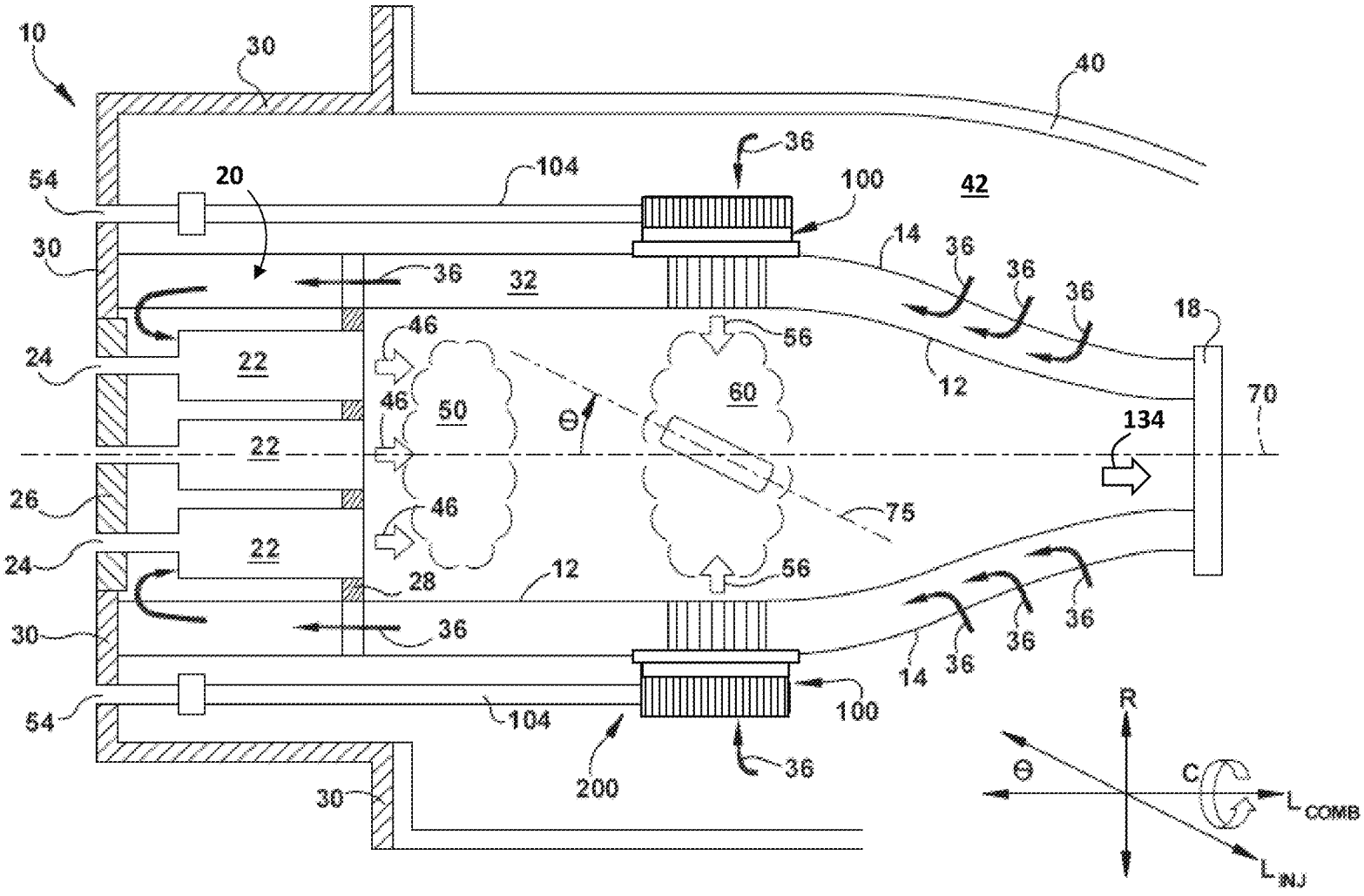
FIG. 2 illustrates a schematic view of a combustor as may be employed in the turbomachine of FIG. 1, wherein the combustor may be configured with a fuel injection assembly in accordance with embodiments of the present disclosure.

FIG. 2 is a schematic representation of a combustor 10 in the form of a combustion can, which may be included in the combustion system 116 in FIG. 1. A plurality of the combustion cans 10 (e.g., 8, 10, 12, 14, 16, or more) are positioned in an annular array about the shaft 122.

As shown in FIG. 2, the combustion can 10 includes a liner 12 that contains and conveys combustion gases 134 to the turbine. The liner 12 may have a cylindrical liner portion and a tapered transition portion that is separate from the cylindrical liner portion, as in many conventional combustion systems. Alternately, the liner 12 may have a unified body (or "unibody") construction, in which the cylindrical portion and the tapered portion are integrated with one another. Thus, any discussion of the liner 12 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine are integrated into a single unit, sometimes referred to as a "transition nozzle" or an "integrated exit piece."

The liner 12 is surrounded by an outer sleeve 14, which is spaced radially outward of the liner 12 to define an annulus 32 between the liner 12 and the outer sleeve 14. The outer sleeve 14 may include a flow sleeve portion at the forward end and an impingement sleeve portion at the aft end, as in many conventional combustion systems. Alternately, the outer sleeve 14 may have a unified body (or "unisleeve") construction, in which the flow sleeve portion and the impingement sleeve portion are integrated with one another in the axial direction. As before, any discussion of the outer sleeve 14 herein is intended to encompass both conventional combustion systems having a separate flow sleeve and impingement sleeve and combustion systems having a unisleeve outer sleeve.

A head end portion 20 of the combustion can 10 includes one or more fuel nozzles 22. The fuel nozzles 22 have a fuel inlet 24 at an upstream (or inlet) end. The fuel inlets 24 may be formed through an end cover 26 at a forward end of the combustion can 10. The downstream (or outlet) ends of the fuel nozzles 22 extend through a combustor cap 28.

The head end portion 20 of the combustion can 10 is at least partially surrounded by a forward casing 30, which is physically coupled and fluidly connected to a compressor discharge case 40. The compressor discharge case 40 is fluidly connected to an outlet of the compressor section (114, shown in FIG. 1) and defines a pressurized air plenum 42 that surrounds at least a portion of the combustion can 10. Air 36 (i.e., compressed air 115 in FIG. 1) flows from the compressor discharge case 40 into the annulus 32 at an aft end of the combustion can 10. Because the annulus 32 is fluidly coupled to the head end portion 20, the air flow 36 travels upstream from the aft end of the combustion can 10 to the head end portion 20, where the air flow 36 reverses direction and enters the fuel nozzles 22.

Fuel and air are introduced by the fuel nozzles 22 into a primary combustion zone 50 at a forward end of the liner 12, where the fuel and air are combusted to form combustion gases 46. In one embodiment, the fuel and air are mixed within the fuel nozzles 22 (e.g., in a premixed fuel nozzle). In other embodiments, the fuel and air may be separately introduced into the primary combustion zone 50 and mixed within the primary combustion zone 50 (e.g., as may occur with a diffusion nozzle). Reference made herein to a "first fuel/air mixture" should be interpreted as describing both a premixed fuel/air mixture and a diffusion-type fuel/air mixture, either of which may be produced by fuel nozzles 22.

The combustion gases 46 travel downstream toward an aft end 18 of the combustion can 10. Additional fuel and air are introduced by one or more fuel injector assemblies 100 (referred to herein as a "fuel injector" or "injector") into a secondary combustion zone 60, where the fuel and air are ignited by the combustion gases 46 to form combustion gases 56. Combustion gases 46 and combustion gases 56 together produce a combined combustion gas product stream 134. Such a combustion system having axially separated combustion zones is described as an "axial fuel staging" (AFS) system 200, and the downstream injectors 100 may be referred to as "AFS injectors." Embodiments of these AFS injectors in accordance with the present disclosure are described in greater detail below.

In the embodiment shown, fuel for each AFS injector 100 is supplied from the head end portion 20 of the combustion can 10, via a fuel inlet 54. Each fuel inlet 54 is coupled to a fuel supply line 104, which is coupled to a respective AFS injector 100. It should be understood that other methods of delivering fuel to the AFS injectors 100 may be employed, including supplying fuel from a ring manifold or from radially oriented fuel supply lines that extend through the compressor discharge case 40.

Each AFS injector 100 is supplied with high pressure air 36 from the pressurized air plenum 42 through an open top end of the injector 100.

FIG. 2 further shows that the AFS injectors 100 may have an elongated shape and may be oriented at an angle $\Theta$ (theta) relative to the longitudinal center line 70 of the combustion can 10. In the embodiment shown, the leading edge portion of the injector 100 (that is, the portion of the injector 100 located most closely to the head end) is oriented away from the center line 70 of the combustion can 10, while the trailing edge portion of the injector 100 is oriented toward the center line 70 of the combustion can 10. The angle $\theta$, defined between the longitudinal axis 75 of the injector 100 and the center line 70, may be between 1 degree and 45 degrees, between 1 degree and 30 degrees, between 1 degree and 20 degrees, or between 1 degree and 10 degrees, or any intermediate value therebetween. In other embodiments, it may be desirable to orient the injector 100, such that the leading edge portion is proximate the center line 70, and the trailing edge portion is distal to the center line 70.

The injectors 100 inject a second fuel/air mixture, in a radial direction, into the combustion liner 12, thereby forming secondary combustion products 56 in the secondary combustion zone 60. The combined hot gases 134 from the primary and secondary combustion zones 50, 60 travel downstream through the aft end 18 of the combustor can 10 and into the turbine section 118 (FIG. 1), where the combustion gases 134 are expanded to drive rotation of blades within the turbine section 118.

Notably, to enhance the operating efficiency of the gas turbine and to reduce emissions, it is desirable for the injector 100 to thoroughly mix fuel and compressed gas to form the second fuel/air mixture prior to introduction into the secondary combustion zone 60. Thus, the injector embodiments 100 described below facilitate improved mixing.

Figure 3:
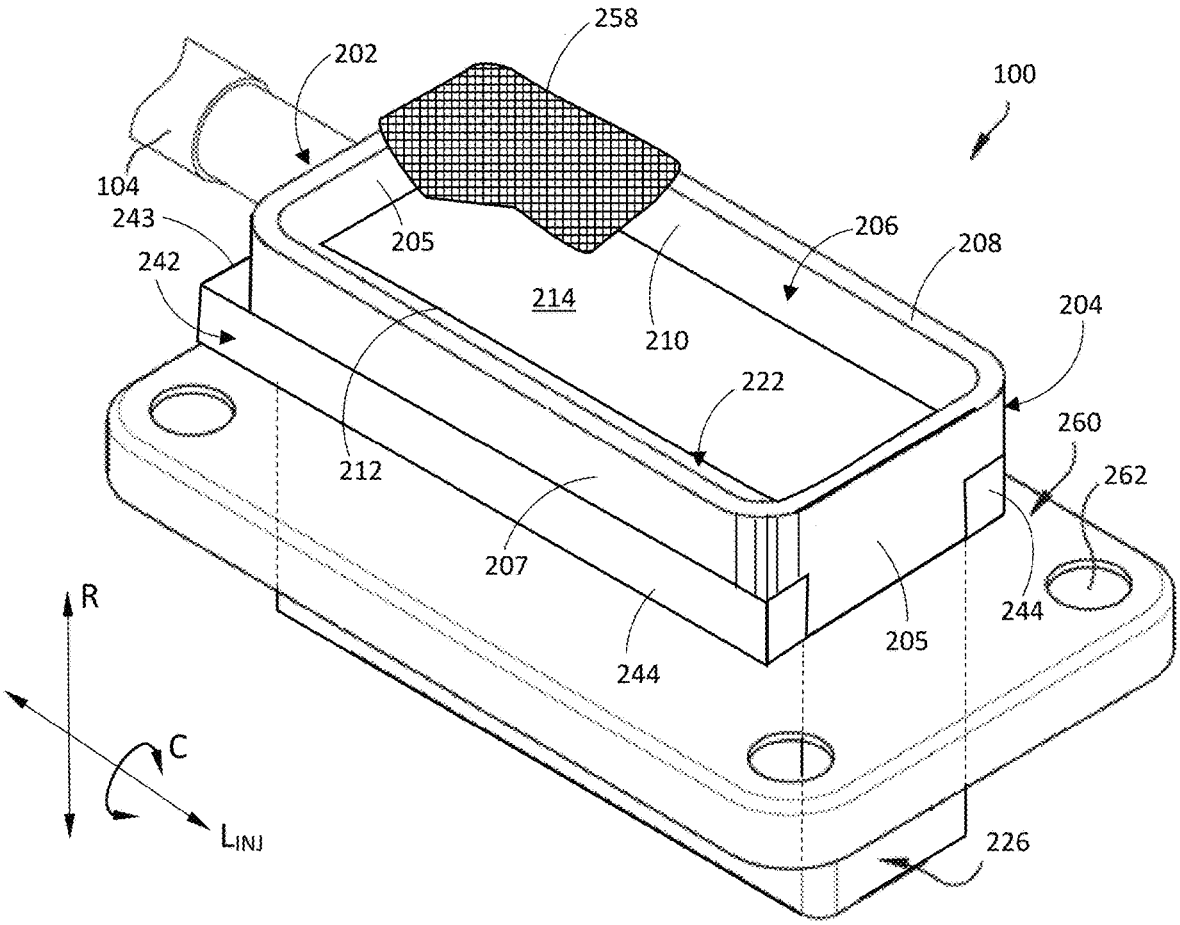
FIG. 3 is a perspective top view of a fuel injection assembly in accordance with embodiments of the present disclosure.
Figure 4:
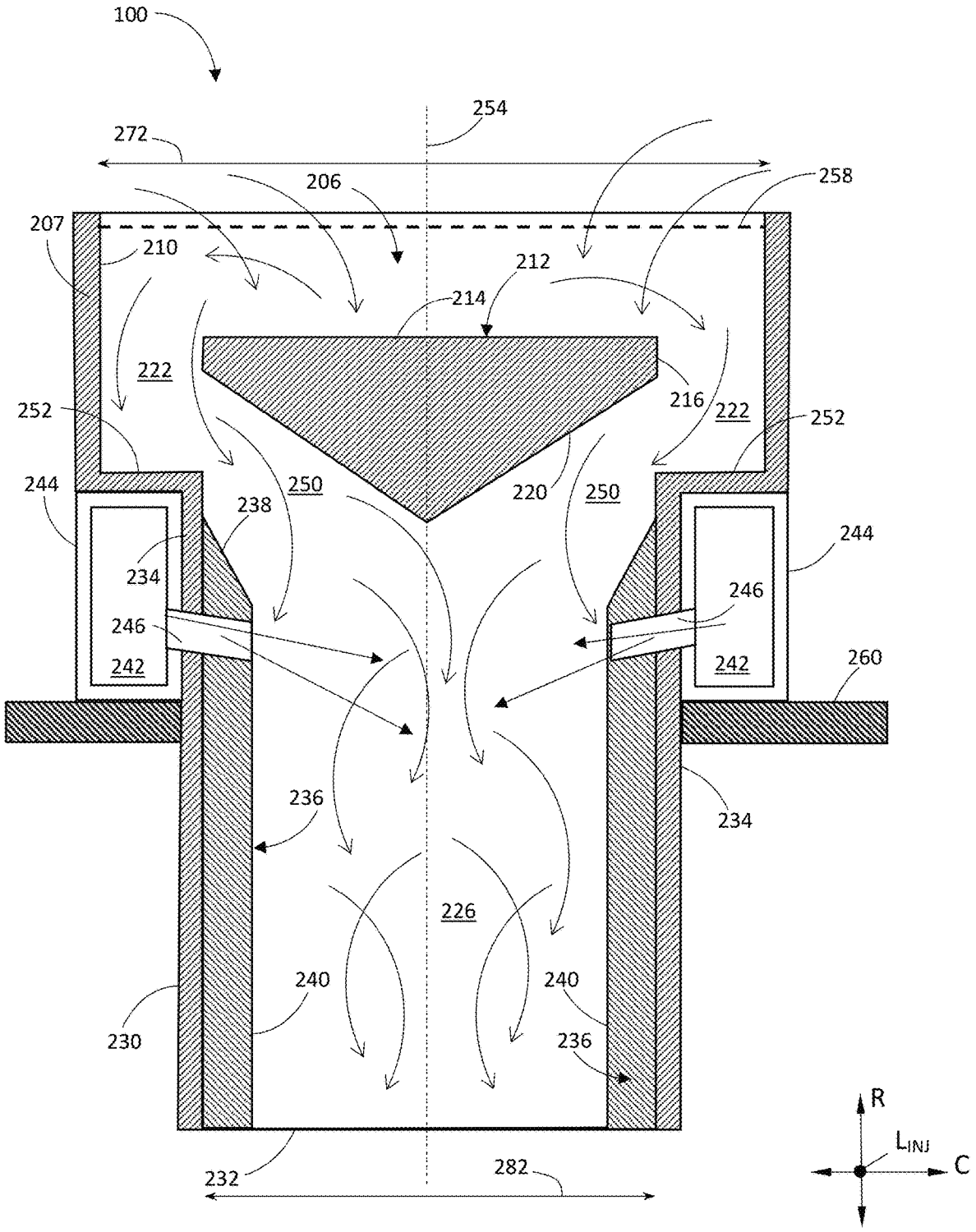
FIG. 4 illustrates a transverse cross-sectional view of the fuel injection assembly of FIG. 3, for use within a combustor in accordance with embodiments of the present disclosure.

FIGS. 3 and 4 depict an embodiment of a fuel injector 100 in accordance with aspects of the invention, wherein the fuel injector 100 is particularly suited as an AFS injector for use in a combustor 10 discussed above. The fuel injector 100 includes a body 202, which may be formed as a single component or multiple components that are formed and subsequently assembled together. The body 202 includes a head section 204 that defines an air intake chamber 206 having an open top end 208. As discussed above with respect to FIG. 2, pressurized air 36 from the high pressure air plenum 42 enters into the injector 100 through the open top end 208.

The body 202 may include a flange 260 with holes 262 used for mounting the fuel injector 100 to the outer sleeve 14 of the combustion can 10 (FIG. 2).

Figure 5:
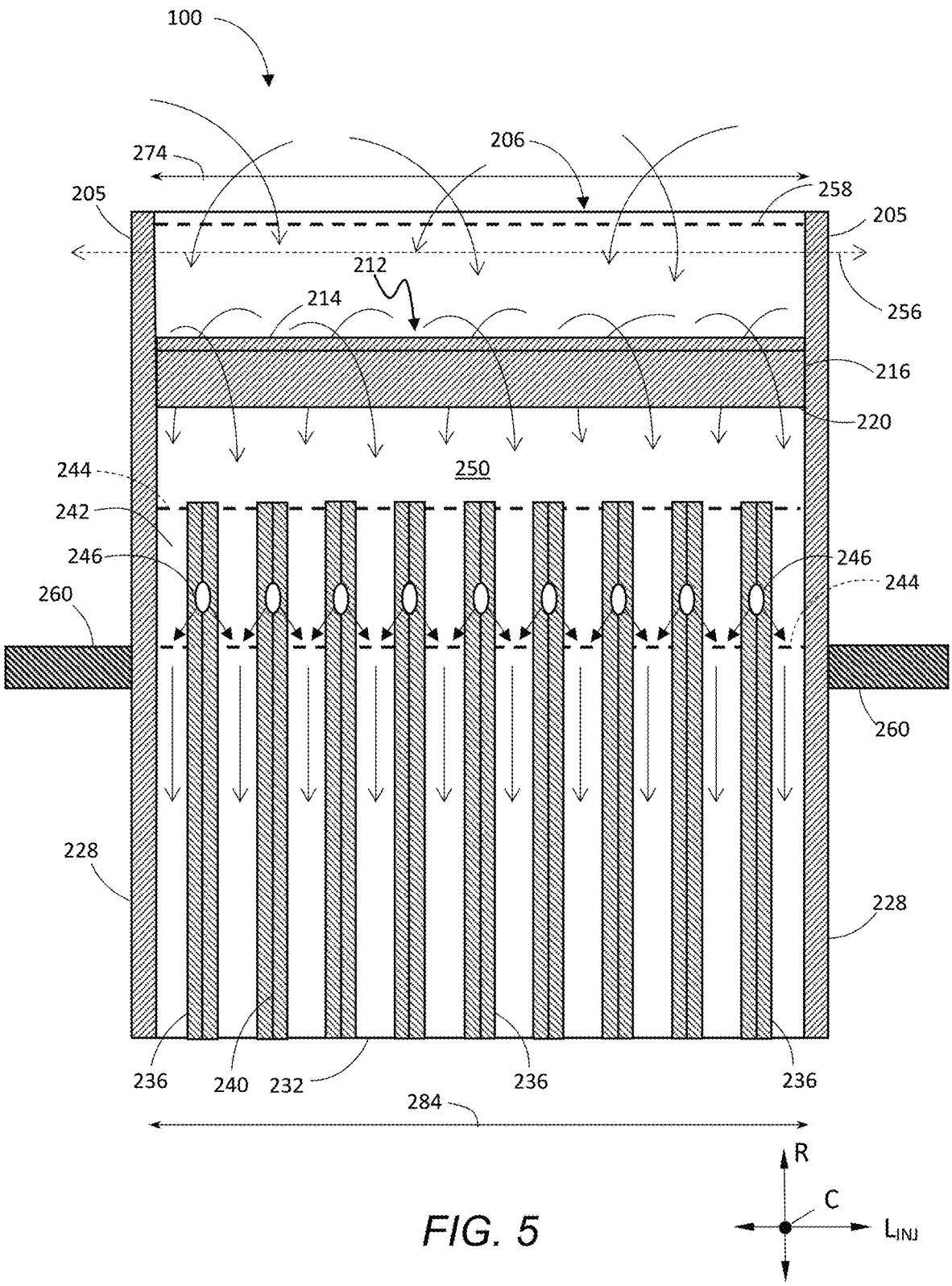
FIG. 5 illustrates a longitudinal cross-sectional view of the fuel injection assembly of FIG. 3, for use within a combustor in accordance with the present disclosure.

The air intake chamber 206 may be variously configured. In the depicted embodiment, the air intake chamber 206 is generally rectangular and includes side walls 207 and transverse end walls 205 (FIG. 5). The side walls 207 have an inner wall surface 210.

Referring particularly to FIG. 4, the fuel injector 100 includes a fuel/air mixing chamber 226 disposed below the air intake chamber 206. This mixing chamber 226 may include side walls 230 having an outer sidewall surface 234, transverse end walls 228, and an open outlet end 232.

A deflection member 212 is disposed in the air intake chamber 206 and includes an upper deflection surface 214 and sides 216, which are spaced apart from the inner wall surfaces 210 of the air intake chamber side walls 207. With this configuration, peripheral air passages 222 are defined between the sides 216 of the deflection member 212 and the side walls 207. These air passages 222 may take the form of longitudinally extending slots. As depicted by the arrows in FIG. 4, pressurized air enters through the open top of the air intake chamber 206 and impinges on the top surface 214 of the deflection member 212, resulting in a turbulent air mass within the intake chamber 206. This turbulent air mass separates and moves through the slot-shaped air passages 222 along the longitudinal sides of the deflection member 212 and into a throat section 250 within the injector 100 where the air mass recombines into a turbulent air mass.

In the embodiment of FIG. 4, the deflection member 212 has a relatively flat upper deflection surface 214 and a tapered or curved lower surface 220 that extends downward into the throat section.

Figure 6:
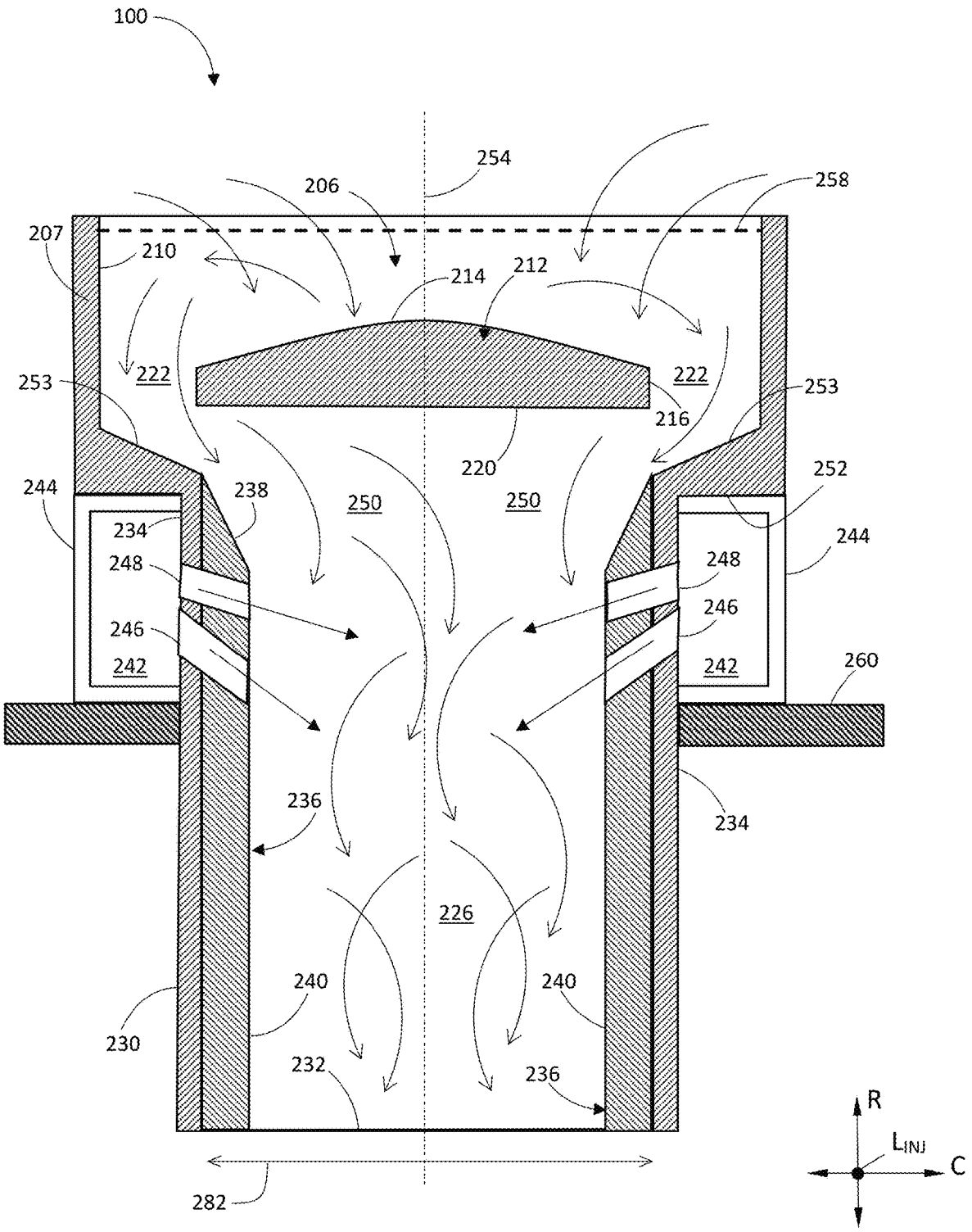
FIG. 6 illustrates a transverse cross-sectional view of another embodiment of a fuel injection assembly, for use within a combustor in accordance with aspects of the present disclosure.

In the embodiment of FIG. 6, the deflection member 212 has a curved or tapered upper deflection surface 214 and a relatively flat lower surface 220. In still another embodiment (not shown), the deflection member 212 may be plate-shaped with a flat upper surface 214 and a flat lower surface 220.

As seen in FIG. 5, the deflection member 212 may extend in the longitudinal direction (relative to the longitudinal axis 256) between the transverse end walls 205 of the air intake chamber 206. Specifically, the deflection member 212 may be joined to each of the transverse end walls 205 and extend from one end wall 205 to the opposite end wall 205.

A plurality of radially extending and longitudinally spaced-apart ribs 236 is disposed within the mixing chamber 226 along inner surfaces of the side walls 230. These ribs 236 extend generally from the throat section 250 towards the open outlet end 232 of the mixing chamber 226. In the depicted embodiment, the ribs 236 terminate at the open outlet end 232. In other embodiments (not shown), one or more of the ribs 232 may be spaced from the outlet end 232. The ribs 236 may be variously configured. In the depicted embodiments, the ribs 236 have a blade-like shape with a relatively straight edge or front face 240 and are aligned generally parallel to a centerline axis 254 through the mixing chamber 226 (i.e., a centerline axis 254 extending in a radial direction R relative to the combustor 10). The ribs 236 may have a tapered leading edge 238, as depicted in FIGS. 4 and 6, which creates a tapered cross-sectional profile of the throat section 250 from the air intake chamber 206 to the mixing chamber 226. In alternate embodiments not depicted in the figures, the ribs 236 may have a scalloped, tapered, or other non-straight edge 240. The ribs 236 may have a slanted or spiral orientation within the mixing chamber 226.

The ribs 236 may have a generally rectangular or square cross-sectional shape in one embodiment. In an alternate embodiment, the ribs 236 may have a generally triangular cross-sectional shape with the apex thereof oriented towards the mixing chamber 226.

Referring to FIGS. 3-7 in general, a fuel plenum 242 is disposed along the longitudinal side walls 230 of the mixing chamber 226. In the depicted embodiments, the fuel plenum 242 is provided by a fuel duct that wraps at least partially around the mixing chamber 226. For example, the fuel duct may include a head section 243 (FIG. 3) that is connected to the fuel supply line 104. The head section 243 is in communication with leg sections 244 that extend alongside the outer sidewall surface 234 of the mixing chamber side walls 230.

A first plurality of fuel injection holes 246 is in fluid communication with the fuel duct (i.e., to the fuel plenum 242 defined within the leg sections 244 of the fuel duct) and is defined through the longitudinal sidewalls 230 of the mixing chamber 226 and through at least some of the ribs 236, as depicted in FIGS. 4 and 5. Thus, a plurality of fuel passages is defined from the fuel duct (i.e., from leg sections 244) and into the mixing chamber 226 through some or all of the ribs 236. The fuel holes 246 may be angled towards the open end 232 of the mixing chamber 226. The fuel holes 246 may be defined in the front face or apex 240 of the ribs 236 facing into the mixing chamber 226. Alternately, or in addition, the fuel holes 246 may be defined in side walls of the ribs and angled into the mixing chamber, as shown in FIG. 7.

In the embodiment of FIG. 4, the legs 244 of the fuel duct are formed by a closed component (e.g., a box-shaped cross-sectional component), and the fuel holes 246 are drilled or otherwise formed through the duct 244, the side walls 230, and the ribs 236. In an alternate embodiment depicted in FIG. 6, the duct 244 is a C-shaped component in which the open side thereof is closed by the outer sidewall surface 234 of the mixing chamber side wall 230. The fuel holes 246 are drilled or otherwise formed through the side wall 230 to be in communication with the internal plenum 242 of the fuel duct 244.

Figure 7:
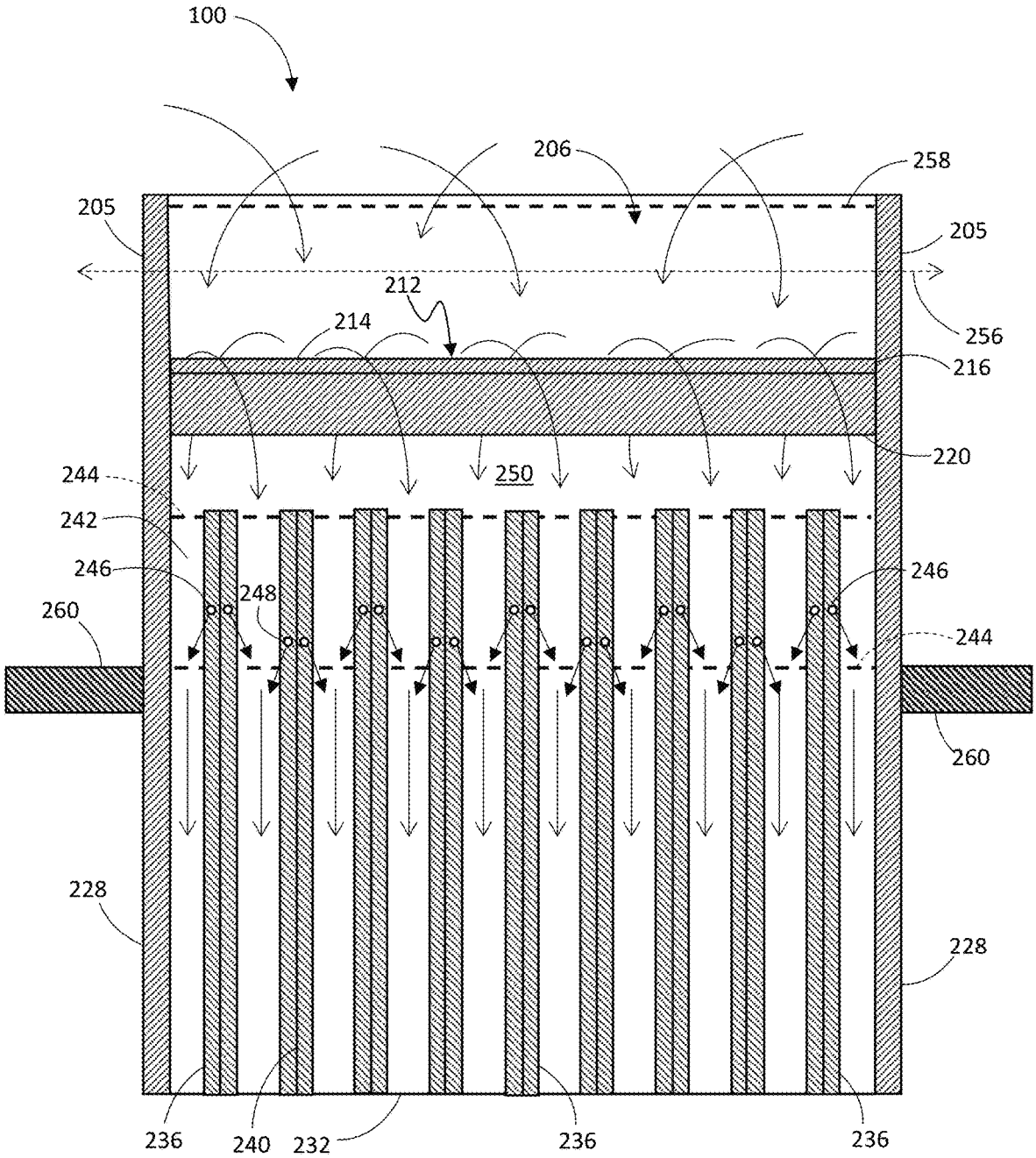
FIG. 7 illustrates a longitudinal cross-sectional view of another embodiment of a fuel injection assembly, for use within a combustor in accordance with aspects of the present disclosure.
Figure 7:
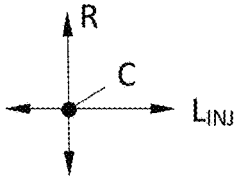

FIGS. 6 and 7 also depict an embodiment in which a second plurality of fuel holes 248 is provided from the fuel duct 244, through at least some of the ribs 236, and into the mixing chamber 226. These fuel holes 248 may be at a different angular orientation as compared to the first fuel holes 246 and may be in different radial positions on the ribs 236. For example, as shown in FIG. 6, at least some of the ribs 236 may be provided with first fuel holes 236 and second fuel holes 248, which are radially spaced apart from one another and which are oriented at different angles. As shown in FIG. 7, the first fuel holes 246 may alternate with the second fuel holes 248 on the ribs 236 (that is, a first set of ribs 236 provided with first fuel holes 246 may alternate with a second set of ribs 236 provided with second fuel holes 248). The first fuel holes 236 may be radially staggered from the second fuel holes 248 and/or may be oriented to introduce the fuel at different angles.

In the depicted embodiments, the air intake chamber 206 includes a stepped ledge 252 between the longitudinal side walls 207 and the mixing chamber 226. The side leg sections 244 of the fuel duct may be located under this ledge 252 and may extend radially to the mounting flange 260 and may be flush with the side walls 207, as seen in FIGS. 4 and 6.

As shown in FIG. 4, the stepped ledge 252 is oriented at a ninety-degree, or approximately ninety-degree, angle relative to longitudinal side walls 207 and at a ninety-degree, or approximately ninety-degree, angle relative to mixing chamber side walls 230. Alternately, as shown in FIG. 6, the outer surface of the stepped ledge may be oriented at a ninety-degree, or approximately ninety-degree, angle relative to longitudinal side walls 207 and mixing chamber side walls 230. However, the inner surface 253 of the stepped ledge 252 may extend at an angle between a longitudinal side wall 207 and a mixing chamber side wall 230, thereby accelerating the air flow around the deflection member 212 and into the throat section 250.

In the shown embodiments, the air intake chamber 206 has a cross-sectional area that is greater than a cross-sectional area of the mixing chamber 226. For example, the air intake chamber 206 may have a rectangular cross-sectional shape with a transverse width 272 and a longitudinal length 274 that is greater than the transverse width 272, and the mixing chamber 226 may have a smaller rectangular cross-sectional shape with a transverse width 282 and a longitudinal length 284 that is greater than the transverse width 282. The transverse width 282 of the mixing chamber 226 is the maximum internal dimension in the circumferential direction (e.g., in areas between the ribs 236). The transverse width 272 of the air intake chamber 206 is greater than the transverse width 282 of the mixing chamber 226.

In exemplary embodiments as depicted in the Figures, the fuel injector 100 may further include a debris filter 258 at the open end 208 of the air intake chamber 206 such that air entering the fuel injector 100 from the high pressure plenum 42 (FIG. 2) passes through the debris filter 258. The debris filter 258 catches any dust, dirt, or other particulates that may be entrained in the air flow from the compressor section 114 (FIG. 1).

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

Clause 1: A fuel injection assembly (100) for a combustor (10) of a gas turbine engine (1000), the fuel injection assembly (100) comprising: a body (202), the body (202) comprising a head section (204) defining an air intake chamber (206); a mixing chamber (226) disposed below the air intake chamber (206), the mixing chamber (226) comprising transverse end walls (228) and longitudinal side walls (230); a deflection member (212) disposed in the air intake chamber (206), the deflection member (212) comprising an upper deflection surface (214) and sides (216) spaced apart from inner wall surfaces (210) of the air intake chamber (206) such that peripheral air passages (222) are defined between the deflection member (212) and the inner wall surfaces (210) of the air intake chamber (206) for air to pass from the air intake chamber (206) into the mixing chamber (226); a plurality of radially extending and longitudinally spaced-apart ribs (236) disposed along an inner surface of each of the longitudinal side walls (230) of the mixing chamber (226); a fuel plenum (242) disposed along the longitudinal side walls (230) of the mixing chamber (226); and a first plurality of fuel injection holes (246, 248) defining a passage from the fuel plenum (242) through the longitudinal side walls (230) of the mixing chamber (226) and through at least some of the ribs (236).

Clause 2: The fuel injection assembly (100) of the preceding clause, wherein the air intake chamber (206) comprises transverse end walls (205) and longitudinal side walls (207), the sides (216) of the deflection member (212) spaced from and parallel to the longitudinal side walls (207) of the air intake chamber (206) such that the peripheral air passages (222) comprise a slot extending along each of the longitudinal side walls (207) of the air intake chamber (206).

Clause 3: The fuel injection assembly (100) of clause 1 or 2, wherein the deflection member (212) extends between the transverse end walls (205) of the air intake chamber (206).

Clause 4: The fuel injection assembly (100) of any preceding clause, wherein the air intake chamber (206) comprises a cross-sectional area that is greater than a cross-sectional area of the mixing chamber (226), and further comprising a throat section (250) between the air intake chamber (206) and the mixing chamber (226).

Clause 5: The fuel injection assembly (100) of any preceding clause, wherein the throat section (250) comprises a tapered cross-sectional profile from the air intake chamber (206) to the mixing chamber (226).

Clause 6: The fuel injection assembly (100) of any preceding clause, wherein the air intake chamber (206) comprises a rectangular cross-sectional shape, and the mixing chamber (226) comprises a smaller rectangular cross-sectional shape.

Clause 7: The fuel injection assembly (100) of any preceding clause, wherein the fuel plenum (242) comprises an external fuel duct (244) adjacent an outer sidewall surface (234) of each of the longitudinal side walls (230) of the mixing chamber (226), the first plurality of fuel injection holes (246, 248) defined through the longitudinal side walls (230) and into the mixing chamber (226).

Clause 8: The fuel injection assembly (100) of any preceding clause, wherein the air intake chamber (206) comprises transverse end walls (205), longitudinal side walls (207), and a stepped ledge (252) between the longitudinal side walls (207) of the air intake chamber (206) and the mixing chamber (226), the external fuel duct (244) disposed under the stepped ledge (252).

Clause 9: The fuel injection assembly (100) of any preceding clause, wherein the deflection member (212) comprises a sloped or curved lower surface (220) that extends from the sides (216) of the deflection member (212) into the throat section (250).

Clause 10: The fuel injection assembly (100) of any preceding clause, wherein the upper deflection surface (214) of the deflection member (212) is flat.

Clause 11: The fuel injection assembly (100) of any preceding clause, wherein the upper deflection surface (214) of the deflection member (212) is sloped or curved towards the sides (216) of the deflection member (212).

Clause 12: The fuel injection assembly (100) of any preceding clause, wherein the ribs (236) extend radially within the mixing chamber (226) to an outlet end (232) of the mixing chamber (226).

Clause 13: The fuel injection assembly (100) of any preceding clause, wherein the first plurality of fuel injection holes (246, 248) extends through a front face or apex of the ribs (236), or through side walls of the ribs (236).

Clause 14: The fuel injection assembly (100) of any preceding clause, wherein the ribs (236) comprise a straight edge (240) that is parallel to a centerline axis (254) through the mixing chamber (226).

Clause 15: The fuel injection assembly (100) of any preceding clause, further comprising a second plurality of fuel injection holes (246, 248) defining a passage from the fuel plenum (242) and through one or more of the ribs (236) into the mixing chamber (236), the second plurality of fuel injection holes (246, 248) spaced vertically from the first plurality of fuel injection holes (246, 248).

Clause 16: An axial fuel staging (AFS) combustor (10) for a gas turbine engine (1000), the AFS combustor (10) comprising: a head end (20); a plurality of fuel nozzles (22) configured at the head end (20); a combustion liner (12)

extending downstream from the plurality of fuel nozzles (22), the combustion liner (12) defining a primary combustion zone (50) at a forward end of the combustion liner (12) and a secondary combustion zone (60) downstream of the primary combustion zone (60); a fuel injection assembly (100) disposed through the liner (12) at the secondary combustion zone (60), wherein the fuel injection assembly (100) comprises: a body (202), the body (202) comprising a head section (204) defining an air intake chamber (206); a mixing chamber (226) disposed below the air intake chamber (206), the mixing chamber (226) comprising transverse end walls (228) and longitudinal side walls (230); a deflection member (212) disposed in the air intake chamber (206), the deflection member (212) comprising an upper deflection surface (214) and sides (216) spaced apart from an inner wall surface (210) of the air intake chamber (206) such that peripheral air passages (222) are defined between the deflection member (212) and the inner wall surfaces (210) of the air intake chamber (206) for air to pass from the air intake chamber (206) into the mixing chamber (226); a plurality of radially extending and longitudinally spaced-apart ribs disposed along each of the longitudinal side walls (230) of the mixing chamber (226); a fuel plenum (242) disposed along the longitudinal side walls (230) of the mixing chamber (226); and a first plurality of fuel injection holes (246, 248) defining a passage from the fuel plenum (242) and through at least some of the ribs (236) into the mixing chamber (226).

Clause 17: The axial fuel staging (AFS) combustor (10) of clause 16, wherein the air intake chamber (206) comprises transverse end walls (205) and longitudinal side walls (207), the sides (216) of the deflection member (212) spaced from and parallel to the longitudinal side walls (207) of the air intake chamber (206) such that the peripheral air passages (222) comprise a slot extending along each of the longitudinal side walls (207) of the air intake chamber (206).

Clause 18: The axial fuel staging (AFS) combustor (10) of clause 16 or 17, wherein the air intake chamber (206) comprises a cross-sectional area that is greater than a cross-sectional area of the mixing chamber (226), and further comprising a throat section (250) between the air intake chamber (206) and the mixing chamber (226).

Clause 19: The axial fuel staging (AFS) combustor (10) of any one of clauses 16-18, wherein the air intake chamber (206) comprises a rectangular cross-sectional shape, and the mixing chamber (226) comprises a smaller rectangular cross-sectional shape; wherein the fuel plenum (242) comprises an external fuel duct (244) attached to an outer sidewall surface (234) of each of the longitudinal side walls (230) of the mixing chamber (226); and wherein the first plurality of fuel injection holes (246, 248) is defined through the longitudinal side walls (230) and each of the ribs (236) and into the mixing chamber (226).

Clause 20: The axial fuel staging (AFS) combustor (10) of any one of clauses 16-19, wherein the air intake chamber (206) comprises transverse end walls (205), longitudinal side walls (207), and a stepped ledge (252) between the longitudinal side walls (207) of the air intake chamber (206) and the mixing chamber (226), the external fuel duct (244) disposed under the stepped ledge (252).

What is claimed is:

1. A fuel injection assembly for a combustor of a gas turbine engine, the fuel injection assembly comprising:

a body, the body comprising a head section defining an air intake chamber;

a mixing chamber disposed below the air intake chamber, the mixing chamber comprising transverse end walls and longitudinal side walls;

a deflection member disposed in the air intake chamber, the deflection member comprising an upper deflection surface and sides spaced from inner wall surfaces of the air intake chamber such that peripheral air passages are defined between the deflection member and the inner wall surfaces for air to pass from the air intake chamber into the mixing chamber;

a plurality of ribs, each rib extending radially and longitudinally and being spaced-apart from neighboring ribs, the plurality of ribs disposed along an inner surface of each of the longitudinal side walls of the mixing chamber;

a fuel plenum disposed along the longitudinal side walls of the mixing chamber; and a first plurality of fuel injection holes defining a passage from the fuel plenum through the longitudinal side walls of the mixing chamber and through at least some of the plurality of ribs.

2. The fuel injection assembly of claim 1, wherein the air intake chamber comprises transverse end walls and longitudinal side walls, the sides of the deflection member spaced from and parallel to the inner surfaces of the longitudinal side walls of the air intake chamber such that the peripheral air passages comprise a slot extending along each of the longitudinal side walls of the air intake chamber.

3. The fuel injection assembly of claim 2, wherein the deflection member extends between the transverse end walls of the air intake chamber.

4. The fuel injection assembly of claim 1, wherein the air intake chamber comprises a cross-sectional area that is greater than a cross-sectional area of the mixing chamber, and further comprising a throat section between the air intake chamber and the mixing chamber.

5. The fuel injection assembly of claim 4, wherein the throat section comprises a tapered cross-sectional profile from the air intake chamber to the mixing chamber.

6. The fuel injection assembly of claim 4, wherein the air intake chamber comprises a rectangular cross-sectional shape and the mixing chamber comprises a smaller rectangular cross-sectional shape than the rectangular cross-sectional shape of the intake chamber.

7. The fuel injection assembly of claim 4, wherein the fuel plenum comprises an external fuel duct adjacent an outer sidewall surface of each of the longitudinal side walls of the mixing chamber, the first plurality of fuel injection holes defined through the longitudinal side walls and into the mixing chamber.

8. The fuel injection assembly of claim 7, wherein the air intake chamber comprises transverse end walls, longitudinal side walls, and a stepped ledge between the longitudinal side walls of the air intake chamber and the mixing chamber, the external fuel ducts disposed under the stepped ledge.

9. The fuel injection assembly of claim 4, wherein the deflection member comprises a sloped or curved lower surface that extends from the sides of the deflection member into the throat section.

10. The fuel injection assembly of claim 1, wherein the upper deflection surface of the deflection member is flat.

11. The fuel injection assembly of claim 1, wherein the upper deflection surface of the deflection member is sloped or curved towards the sides of the deflection member.

12. The fuel injection assembly of claim 1, wherein the plurality of ribs extend radially within the mixing chamber to an outlet end of the mixing chamber.

13. The fuel injection assembly of claim 1, wherein the first plurality of fuel injection holes extends through a front face or apex of the plurality of ribs, or through side walls of the plurality of ribs.

14. The fuel injection assembly of claim 1, wherein the plurality of ribs comprise a straight edge that is parallel to a centerline axis through the mixing chamber.

15. The fuel injection assembly as in claim 1, further comprising a second plurality of fuel injection holes defining a passage from the fuel plenum, through one or more of the plurality of ribs, and into the mixing chamber, the second plurality of fuel injection holes spaced vertically from the first plurality of fuel injection holes.

16. An axial fuel staging (AFS) combustor for a gas turbine engine, the AFS combustor comprising:

a head end;

one or more fuel nozzles configured at the head end;

a combustion liner extending downstream from the one or more fuel nozzles, the combustion liner defining a primary combustion zone at a forward end of the combustion liner and a secondary combustion zone downstream from the primary combustion zone;

a fuel injection assembly disposed through the combustion liner at the secondary combustion zone, wherein the fuel injection assembly comprises:

a body, the body comprising a head section defining an air intake chamber;

a mixing chamber disposed below the air intake chamber, the mixing chamber comprising transverse end walls and longitudinal side walls;

a deflection member disposed in the air intake chamber, the deflection member comprising an upper deflection surface and sides spaced apart from inner wall surfaces of the air intake chamber such that peripheral air passages are defined between the deflection member and the inner wall surfaces of the air intake chamber for air to pass from the air intake chamber into the mixing chamber;

a plurality of ribs, each rib extending longitudinally and spaced-apart from neighboring ribs, the plurality of ribs disposed along each of the longitudinal side walls of the mixing chamber;

a fuel plenum disposed along the longitudinal side walls of the mixing chamber; and a first plurality of fuel injection holes defining a passage from the fuel plenum and through at least some of the plurality of ribs into the mixing chamber.

17. The axial fuel staging (AFS) combustor of claim 16, wherein the air intake chamber comprises transverse end walls and longitudinal side walls, the sides of the deflection member spaced from and parallel to the inner surfaces of the longitudinal side walls of the air intake chamber such that the peripheral air passages comprise a slot extending along each of the longitudinal side walls of the air intake chamber.

18. The axial fuel staging (AFS) combustor of claim 16, wherein the air intake chamber comprises a cross-sectional area that is greater than a cross-sectional area of the mixing chamber, and further comprising a throat section between the air intake chamber and the mixing chamber.

19. The axial fuel staging (AFS) combustor of claim 18, wherein the air intake chamber comprises a rectangular cross-sectional shape and the mixing chamber comprises a smaller rectangular cross-sectional shape than the rectangular cross-sectional shape of the intake chamber; wherein the fuel plenum comprises an external fuel duct attached to an outer sidewall surface of each of the longitudinal side walls of the mixing chamber; and wherein the first plurality of fuel injection holes is defined through the longitudinal side walls and each of the plurality of ribs and into the mixing chamber.

20. The axial fuel staging (AFS) combustor of claim 19, wherein the air intake chamber comprises transverse end walls, longitudinal side walls, and a stepped ledge between the longitudinal side walls of the air intake chamber and the mixing chamber, the external fuel ducts disposed under the stepped ledge.

* * * * *